US007245739B2

(12) United States Patent
Suzuki

(10) Patent No.: US 7,245,739 B2
(45) Date of Patent: Jul. 17, 2007

(54) DOME TYPE DIAPHRAGM AND LOUDSPEAKER APPARATUS

(75) Inventor: Tatsuya Suzuki, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 11/023,446

(22) Filed: Dec. 29, 2004

(65) Prior Publication Data

US 2005/0152576 A1 Jul. 14, 2005

(30) Foreign Application Priority Data

Jan. 14, 2004 (JP) ..... P2004-007091

(51) Int. Cl.
*H04R 25/00* (2006.01)

(52) U.S. Cl. ..... 381/430; 381/398

(58) Field of Classification Search ..... 381/398, 381/430, 423, 424, 432, 425–428, 401, 403, 381/412, 396, 400, 404, 409, 410; 181/148, 181/153, 164, 165, 167–170, 173, 174, 157, 181/171, 172

See application file for complete search history.

(56) References Cited

U.S. PATENT DOCUMENTS 3,955,055 A * 5/1976 Kawakami et al. ..... 381/430
6,154,556 A * 11/2000 Takahashi et al. ..... 381/430
2004/0170297 A1* 9/2004 Hikichi ..... 381/430

FOREIGN PATENT DOCUMENTS

JP 2-312396 A 12/1990

* cited by examiner

*Primary Examiner*—Huyen Le
(74) *Attorney, Agent, or Firm*—Sughrue Mion, PLLC

(57) ABSTRACT

A loudspeaker apparatus includes a frame having an opening portion, a magnetic circuit constructed within the opening portion, a voice coil 27 in which a rear opening end portion is inserted into a magnetic gap of the magnetic circuit, a dome type diaphragm covered over the front opening end portion of the voice coil, and an edge for holding an outer peripheral portion of the voice coil freely vibratingly, with the outer peripheral edge attached on an opening portion of the frame. A reinforcing portion formed at an outer peripheral edge of the dome type diaphragm is formed of a flat portion and a cone portion, and has a shape of being folded back in a sound radiating direction toward a front.

4 Claims, 5 Drawing Sheets

DOME TYPE DIAPHRAGM AND LOUDSPEAKER APPARATUS

BACKGROUND OF THE INVENTION

1. Field of the Invention

The present invention relates to a dome type diaphragm and a loudspeaker apparatus.

2. Description of the Related Art

Conventionally, the dome type diaphragm has been widely employed in the loudspeaker apparatus for reproduction of middle and high pitched sound (e.g., refer to JP-A-2-312396).

FIG. 1 shows a conventional example of the loudspeaker apparatus having the dome type diaphragm.

The loudspeaker apparatus 1 as shown here has a top plate 5 composed of a disk-like magnetic substance provided in front (upwards in FIG. 1) of a disk-like magnet (permanent magnet) 4, and a barrel-type yoke 6 provided from the rear to front part of the magnet 4 to constitute a magnetic circuit of inner magnetization type, with a magnetic gap 10 being formed between the outer circumference of the top plate 5 and the inner circumference in front of the barrel-type yoke 6.

Also, a voice coil 7 having the windings 12 wound around the outer peripheral face in the rear of a cylindrical bobbin 8 is covered over the front opening end portion around which the dome type diaphragm 11 is fitted, with an annular edge (edge member) 9 provided around its outer circumference.

And the voice coil 7 has a rear opening end portion of the bobbin 8 disposed in the magnetic gap 10 so that the windings 12 maybe located in the magnetic gap 10, and an outer peripheral portion of the edge 9 is fixed to the frame 2. Thus, the voice coil 7 is held via the edge 9 in the frame 2 freely vibratingly.

The dome type diaphragm 11 is formed like a dome type from a metal thin plate of aluminum alloy or the like, with a flat reinforcing portion 11*a* extending horizontally on its outer peripheral edge. That is, the flat reinforcing portion 11*a* is disposed to extend on the outer peripheral edge of the metal thin plate formed like the dome type to secure the mechanical strength of the dome type diaphragm 11 and improve the high frequency characteristics of the loudspeaker apparatus 1.

Moreover, each end of the windings 12 wound around the bobbin 8 is connected via a connection portion provided on the outer peripheral face of the bobbin 8 to one end of the lead wire 14, the other end of the lead wire 14 being connected to a terminal 16 of a connector portion 20 molded integrally with the frame 2.

A cover 3 mounted on the frame 2 is placed above the dome type diaphragm 11. This cover 3 protects the dome type diaphragm 11 from a physical external force, and appropriately radiates the sound produced by the dome type diaphragm 11 through a plurality of sound radiating holes.

Thus, if a signal current is supplied to the windings 12 connected to an amplifier via a connection cable of the other connector (not shown) fitted into the connector portion 20 and the lead wire 14, the dome type diaphragm 11 is vibrated along with the voice coil 7 to output the sound.

However, when the flat reinforcing portion 11*a* is disposed to extend around the outer peripheral edge of the dome type diaphragm 11 as described above, there is the possibility that the flat reinforcing portion 11*a* may interfere with a curved portion 9*a* of the edge 9, or the lead wire 14 disposed on the front face of the edge 9 and the metallic flat reinforcing portion 11*a* may be contacted and short-circuited, whereby it is required that the height H1 of the bobbin 8 in the bobbin coil 7 is increased to keep a clearance between the edge 9 and the flat reinforcing portion 11*a*.

Thus, the voice coil 7 with the height H1 increased has a problem that the rigidity is reduced to cause a transmission loss, and the weight is increased to attenuate the high frequency characteristics.

SUMMARY OF THE INVENTION

According to a first aspect of the invention, a dome type diaphragm for a loudspeaker covered over a front opening end portion of a voice coil having an edge member attached on an outer peripheral portion of the voice coil, includes: an outer peripheral edge having a shape of being folded back in a direction of a sound radiated from a front face of the dome type diaphragm.

According to a second aspect of the invention, a loudspeaker apparatus includes a frame having an opening portion, a magnetic circuit constructed within the opening portion, a voice coil in which a rear opening end portion is inserted into a magnetic gap of the magnetic circuit, a dome type diaphragm covered over a front opening end portion of the voice coil and an edge member holding an outer peripheral portion of the voice coil freely vibratingly and having an outer peripheral edge attached on the opening portion of the frame. An outer peripheral edge of the dome type diaphragm has a shape of being folded back in a direction of a sound radiated from a front face of the dome type diaphragm.

DETAILED DESCRIPTION OF THE PREFERRED EMBODIMENTS

Figure 1:
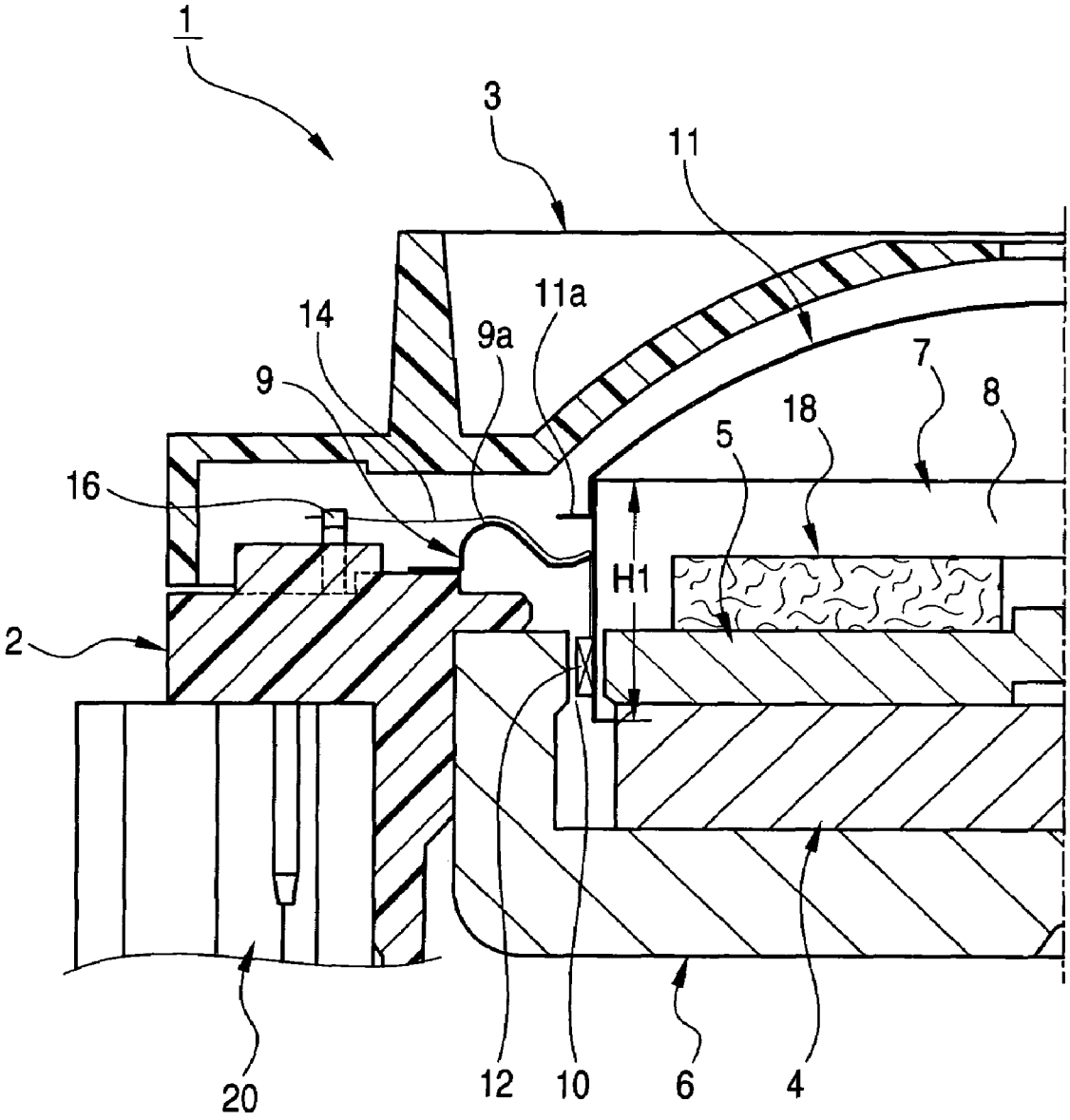
FIG. 1 PRIOR ART
FIG. 1 is a cross-sectional view of the essence of the conventional loudspeaker apparatus.

The preferred embodiments of a dome type diaphragm and a loudspeaker apparatus according to the present invention will be described below.

The dome type diaphragm of the invention is useful for the loudspeaker apparatus and covered over a front opening end portion of a voice coil with an edge member attached on the outer circumference. An outer peripheral edge of the dome type diaphragm has a shape of being folded back in a sound radiating direction toward the front.

That is, the dome type diaphragm covered over the front opening end portion of the voice coil has a shape in which the outer peripheral edge is folded back in the sound radiating direction toward the front of the loudspeaker and has a reinforcing portion extending in a direction away from the edge member.

Thus, the dome type diaphragm keeps a sufficient clearance with the edge member to prevent interference, and secure the mechanical strength.

Also, the loudspeaker apparatus of the invention comprises a frame having an opening portion, a magnetic circuit made within the opening portion, a voice coil in which a rear opening end portion is inserted into a magnetic gap of the magnetic circuit, a dome type diaphragm covered over the front opening end portion of the voice coil, and an edge member for holding an outer peripheral portion of the voice coil freely vibratingly, with the outer peripheral edge attached on an opening portion of the frame, in which the outer peripheral edge of the dome type diaphragm has a shape of being folded back in the sound radiating direction toward the front.

That is, the dome type diaphragm covered over the front opening end portion of the voice coil has the outer peripheral edge of the shape of being folded back in the sound radiating direction in front of the loudspeaker and has a reinforcing portion extending in a direction away from the edge member.

Thus, the dome type diaphragm keeps a sufficient clearance with the edge member to prevent interference, while securing the mechanical strength, and the height of the voice coil is reduced.

Accordingly, the voice coil having lower height has higher rigidity, less transmission loss, and reduced weight, whereby the high frequency characteristics of the loudspeaker apparatus are improved.

Moreover, the dome type diaphragm of the loudspeaker apparatus comprising a conductive material, and a lead wire connected to the windings of the voice coil is disposed on the front face of the edge member. Thereby, it is possible to prevent the lead wire disposed on the front face of the edge member and the dome type diaphragm formed of the conductive material such as metal from being contacted and short-circuited, and reduce the height of the voice coil.

The sound radiating direction toward the front is a direction of a sound being radiated from a front face of the dome type diaphragm. And the "being folded back in the sound radiating direction toward the front" as used in the invention means that the peripheral edge is folded back toward the front at an angle with respect to a horizontal plane orthogonal to the vibration direction of the voice coil.

EXAMPLES

The examples of the dome type diaphragm and the loudspeaker apparatus according to the invention will be described below with reference to the accompanying drawings.

Figure 2:
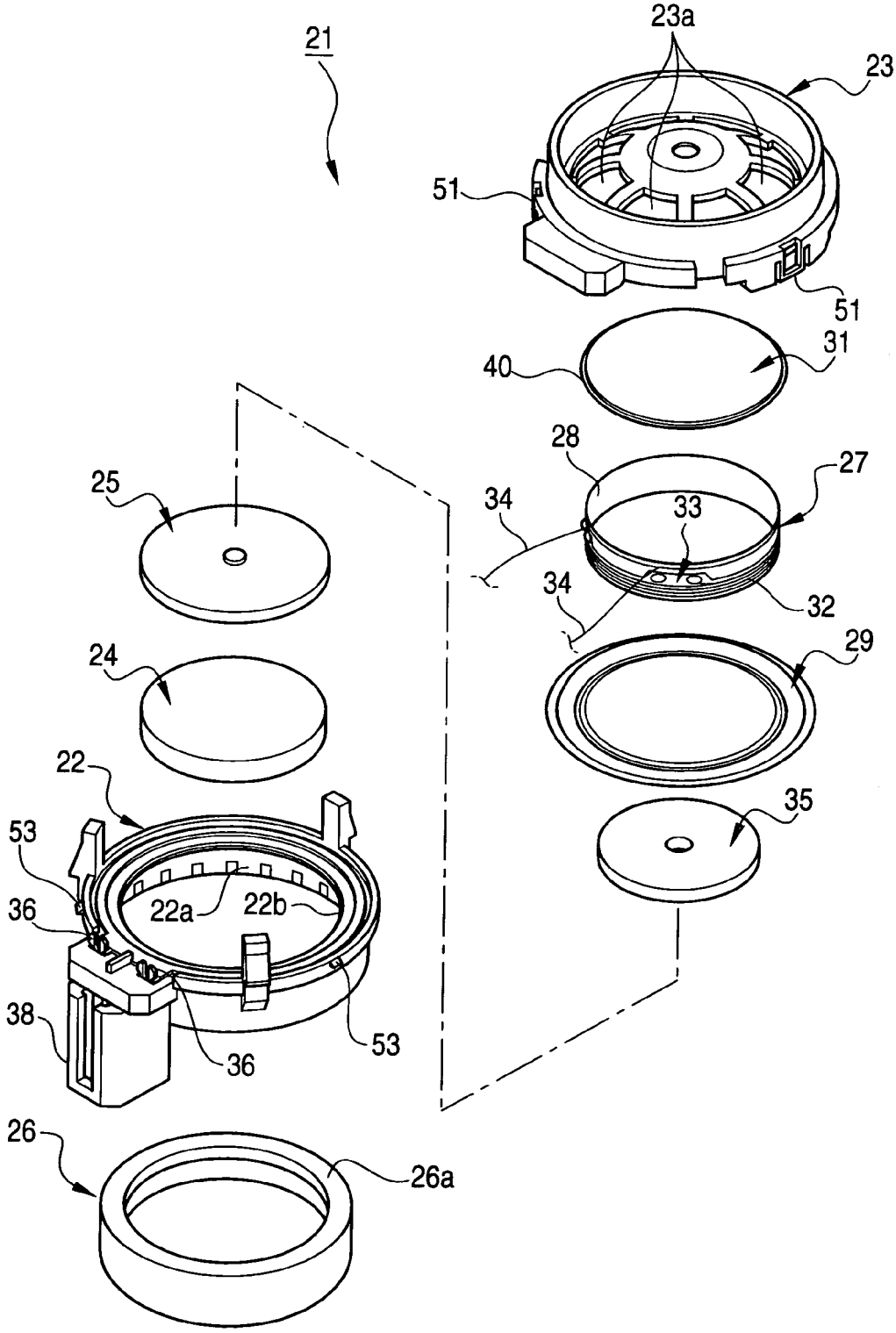
FIG. 2 is an exploded perspective view of a loudspeaker apparatus according to an embodiment of the invention.
Figure 3:
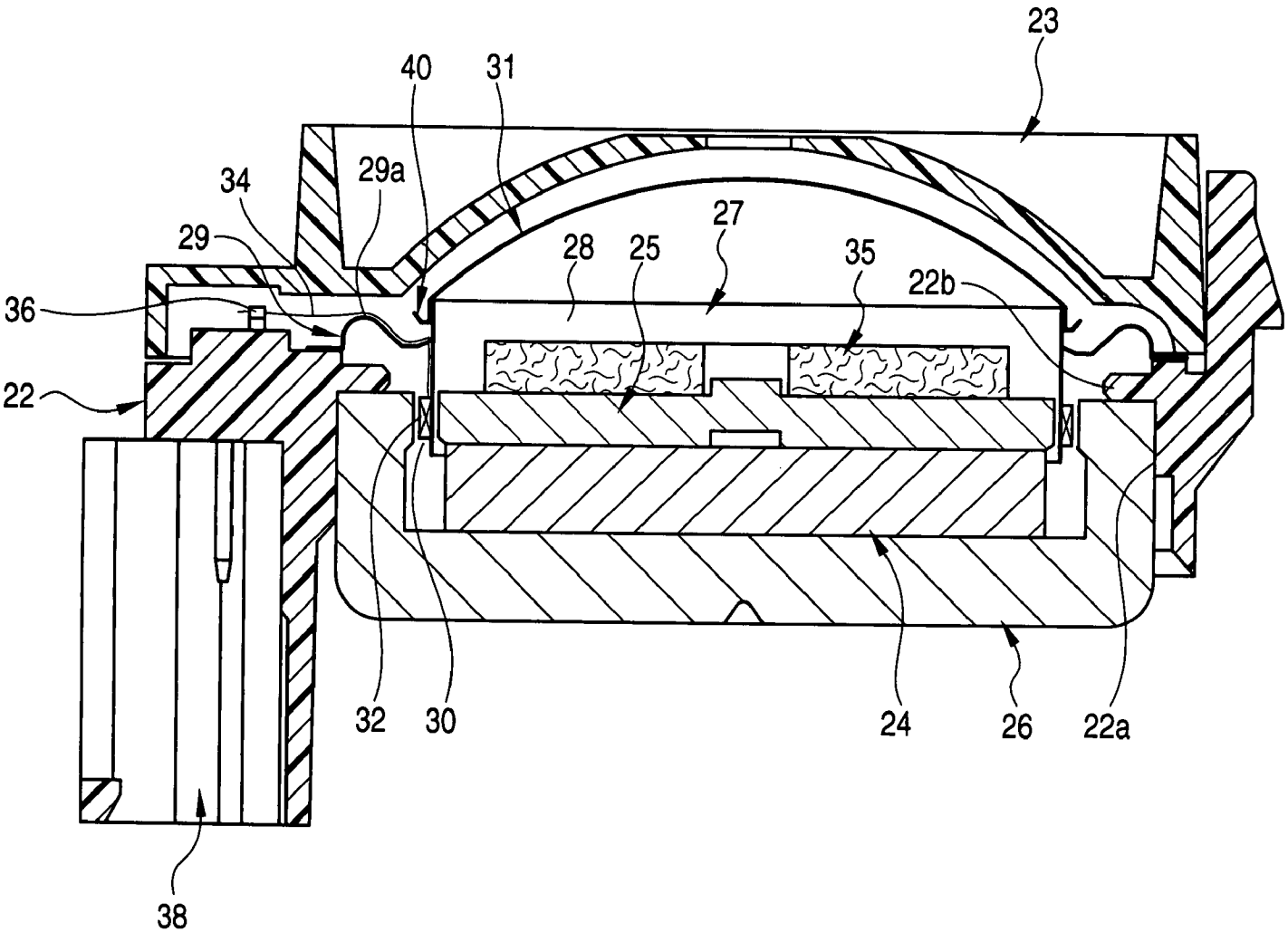
FIG. 3 is a longitudinal cross-sectional view of the loudspeaker apparatus according to the embodiment of the invention.
Figure 4:
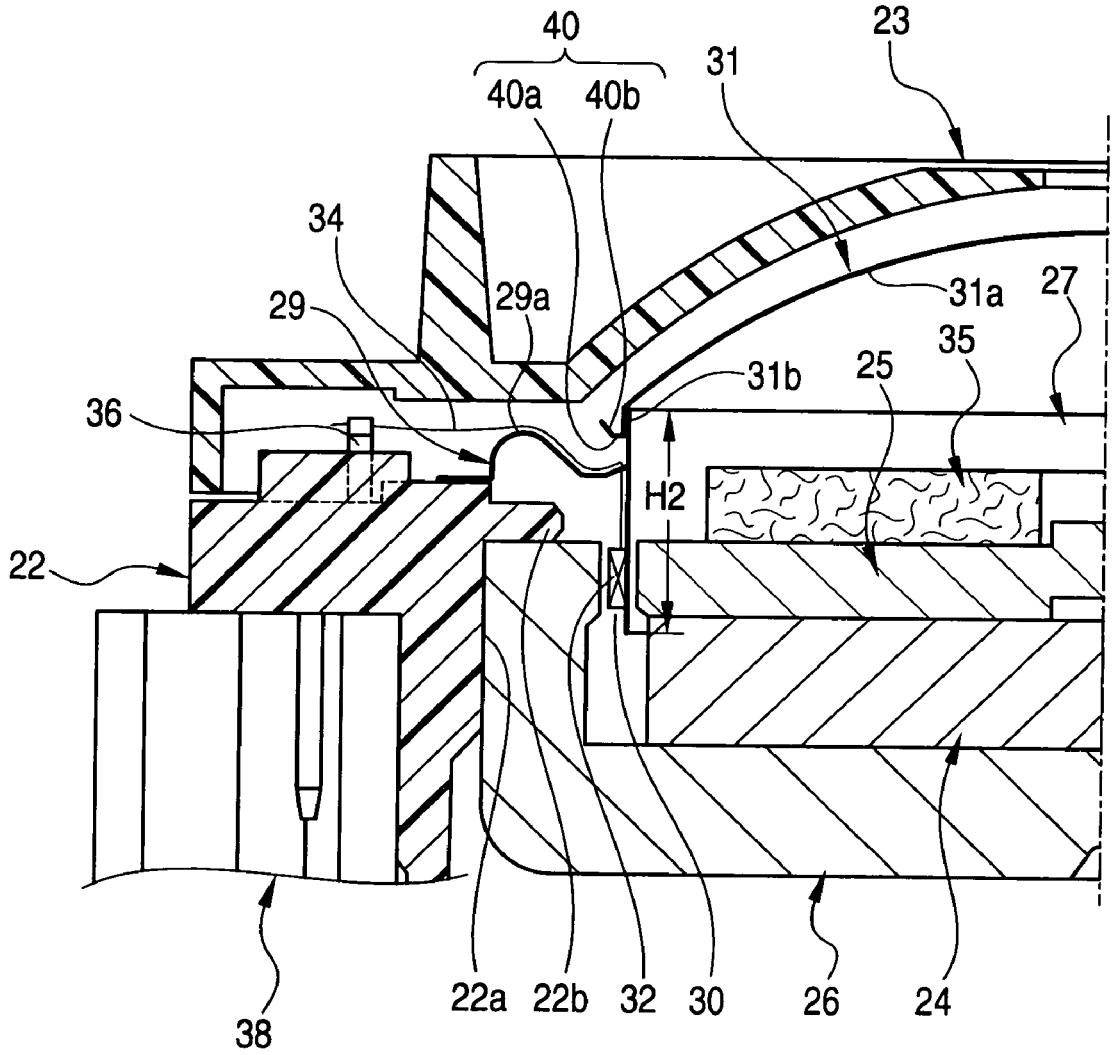
FIG. 4 is an enlarged cross-sectional view of the essence of the loudspeaker apparatus as shown in FIG. 3.

FIGS. 2 to 4 show the loudspeaker apparatus having the dome type diaphragm according to an example of the invention.

The loudspeaker apparatus 21 of this example as shown in FIG. 2 is a dome type loudspeaker apparatus having a top plate 25 and a sound absorbent 35 composed of a disk-like magnetic substance provided in front (upwards in FIG. 2) of a disk-like magnet (permanent magnet) 24, and a barrel-type yoke 26 from the rear to front part of the magnet 24 to constitute a magnetic circuit of inner magnetization type, with a magnetic gap 30 being formed between the outer circumference of the top plate 25 and the inner circumference in front of the barrel-type yoke 26.

The barrel-type yoke 26 is the metallic yoke composed of a magnetic substance in the shape of a U-character as seen in cross section, as shown in FIGS. 2 and 3, and inserted and fitted till a top end 26*a* of the peripheral wall abuts against an annular rib 22*b* protruding on the inner peripheral face of an opening portion 22*a* in the frame 22, and fixed by adhesives in a state where it is positioned by the inner peripheral face of the opening portion 22*a* and the annular rib 22*b*.

Also, a dome type diaphragm 31 is fitted around and covered over a front opening end portion of a voice coil 27 having the windings 32 wound around the outer peripheral face in the rear of a cylindrical bobbin 28.

Also, an annular edge (edge member) 29 having an inner peripheral portion bonded to the outer peripheral face of the bobbin 28 is provided on the outer circumference of the voice coil. This edge 29 is made of an elastic material such as urethane or rubber, for example, and has a curved portion 29*a* formed like a circular arc in cross section.

And the voice coil 27 has the rear opening end portion of the bobbin 28 disposed in the magnetic gap 30 and the outer peripheral portion of the edge 29 fixed to the frame 22 so that the windings 32 wound around the outer peripheral portion may be located in the magnetic gap 30. Thus, the voice coil 27 is held via the edge 29 within the opening portion 22*a* of the frame 2 freely vibratingly.

The dome type diaphragm 31 is formed like a dome type from a metal thin plate of aluminum alloy or the like, and integrally formed of a spherical dome portion 31*a*, a cylindrical portion 31*b* protruded at the peripheral edge of the dome portion 31*a* and fitted around the front opening end portion of the voice coil 27, and a reinforcing portion 40 provided in the rear opening end portion of the cylindrical portion 31*b*, as shown in FIG. 4.

Figure 5A:
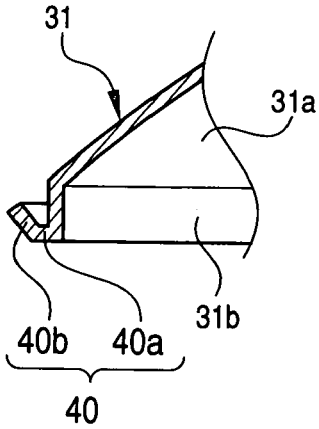
FIGS. 5A to 5C are enlarged cross-sectional views of the essence of a dome type diaphragm according to a modified embodiment of the invention.

This reinforcing portion 40 has a shape in which the outer peripheral edge of the dome type diaphragm 31 is folded back in the sound radiating direction toward the front, and comprises a flat portion 40*a* extending horizontally from the rear opening end portion of the cylindrical portion 31*b*, and a cone portion 40*b* extending forwards at an appropriate angle from the outer peripheral end portion of the flat portion 40*a*, as shown in FIGS. 4 and 5A.

That is, the dome type diaphragm 31 has the reinforcing portion 40 at the outer peripheral edge of the metal thin plate formed like dome type to secure the mechanical strength.

Moreover, each end of the windings 32 wound around the bobbin 28 is connected via a connection portion 33 provided on the outer peripheral face of the bobbin 28 to one end of the lead wire 34, the other end of the lead wire 34 being connected to a terminal 36 of a connector portion 38 molded integrally with the frame 22.

Thus, if a signal current is supplied to the windings 32 connected to an amplifier via a connection cable of the other connector (not shown) fitted into the connector portion 38 and the lead wire 34, the dome type diaphragm 31 is vibrated along with the voice coil 27 to output the sound.

A cover 23 mounted on the frame 22 is placed above the dome type diaphragm 31. This cover 23 is molded like the dome type according to the shape of the dome type diaphragm 31, and positioned and secured integrally with the frame 22, when a plurality of engagement pieces 51 formed at a plurality of positions along the outer peripheral wall are engaged by the engaging projections 53 formed at the frame 22.

And this cover 23 is formed with a plurality of sound radiating holes 23*a*, and protects the dome type diaphragm 31 from a physical external force, and appropriately radiates the sound produced by the dome type diaphragm 31 through a plurality of sound radiating holes 23*a*.

That is, according to the example of the loudspeaker 21, the outer peripheral edge of the dome type diaphragm 31 is folded back toward the front (upwards) at an angle with respect to a horizontal plane orthogonal to the vibration direction (vertical direction in FIG. 3) of the voice coil 27.

Thus, the dome type diaphragm 31 covered over the front opening end portion of the voice coil 27 has a shape in which the outer peripheral edge is folded back in the sound radiating direction toward the front of the loudspeaker and has the reinforcing portion 40 extending in a direction away from the edge 29.

Accordingly, the dome type diaphragm 31 of this example keeps a sufficient clearance with the edge 29 having the curved portion 29*a* that is convex in front of the loudspeaker to prevent interference, and secure the mechanical strength.

And the loudspeaker apparatus 21 of this example as shown in FIG. 4 keeps a clearance between the edge 29 and the reinforcing portion 40 even when the height H2 of the bobbin 28 in the bobbin coil 27 is lower than the height H1 of the conventional bobbin 8 as shown in FIG. 1.

Thus, the voice coil 27 of this example with the lower height H2 has higher rigidity, a smaller transmission loss, and less weight to improve the high frequency characteristics of the loudspeaker.

Moreover, though the dome type diaphragm 31 of this example is formed from a metal thin plate of conductive material, and the lead wire 34 connected to the windings 32 of the voice coil 27 is disposed on the front face of the edge 29, it is possible to prevent the lead wire 34 disposed on the front face of the edge 29 and the dome type diaphragm 31 from being contacted and short-circuited, and reduce the height H2 of the voice coil 27.

Thus, the loudspeaker apparatus 21 of this example is easier to assemble compared with the case where the lead wire 34 is disposed on the rear face of the edge 29, and does not cause the manufacturing cost to be increased.

In the dome type diaphragm and the loudspeaker apparatus of this invention, the frame, the magnetic circuit, the voice coil, the dome type diaphragm and the edge member are not limited in the constitution to those of the above example, but may be embodied in various forms without departing from the spirit of the invention.

The dome type diaphragm 31 of this example has the reinforcing portion 40 having the shape in which the outer peripheral edge is folded back in the sound radiating direction toward the front, the reinforcing portion 40 being formed of the flat portion 40*a* and the cone portion 40*b*, as shown in FIG. 5A. However, this invention is not limited thereto.

Figure 5B:
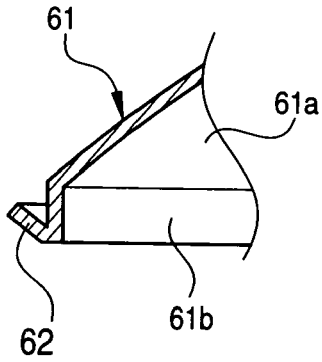

For example, a reinforcing portion 62 of a dome type diaphragm 61 as shown in FIG. 5B comprises a cone portion extending forwards at an appropriate angle from the rear opening end portion of a cylindrical portion 61*b* protruded at the peripheral edge of a dome portion 61*a*.

Figure 5C:
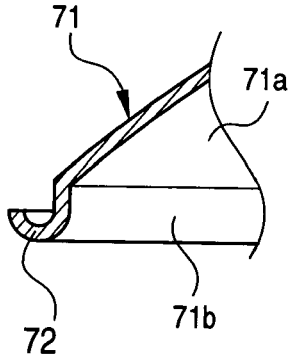

Also, a reinforcing portion 72 of a dome type diaphragm 71 as shown in FIG. 5C comprises a curved portion extending forwards in the shape of U-character in cross section from the rear opening end portion of a cylindrical portion 71*b* protruded at the peripheral edge of a dome portion 71*a*.

Moreover, though the dome type diaphragm 31 of this example is the dome type diaphragm having the dome portion 31*a* that is circular in plan view, the dome type diaphragm of this invention may be the dome type diaphragm having the dome portion that is elliptic or oblong in plan view.

What is claimed is:

1. A loudspeaker apparatus comprising:

a frame having an opening portion;

a magnetic circuit constructed within the opening portion:

a voice coil in which a rear opening end portion is inserted into a magnetic gap of the magnetic circuit;

a dome type diaphragm covered over a front opening end portion of the voice coil; and an edge member holding an outer peripheral portion of the voice coil freely vibratingly and having an outer peripheral edge attached on the opening portion of the frame, wherein an outer peripheral edge of the dome type diaphragm is positioned outside an outer peripheral side of the voice coil and the outer peripheral edge terminates without contacting any other portion of the loudspeaker apparatus and has a shape of being folded back in a direction of a sound radiated from a front face of the dome type diaphragm, and the outer peripheral edge is located on a front side of the edge member.

2. The loudspeaker apparatus according to claim 1, wherein the dome type diaphragm comprising a conductive material, and a lead wire connected to a windings of the voice coil is disposed on a front face of the edge member.

3. The dome type diaphragm according to claim 1, wherein an acute angle is formed between the outer peripheral edge of the diaphragm and an outer peripheral surface of the voice coil.

4. The dome type diaphragm according to claim 1, wherein an acute angle is formed between an imaginary line extended along a direction of the outer peripheral edge of the diaphragm and an outer peripheral surface of the voice coil.

* * * * *